US011858714B2

(12) United States Patent
Kouchacji

(10) Patent No.: US 11,858,714 B2
(45) Date of Patent: Jan. 2, 2024

(54) SEALABLE VACUUM LUGGAGE BAG

(71) Applicant: Lucid Presence, LLC, Sheridan, WY (US)

(72) Inventor: Gabrielle Kouchacji, Sheridan, WY (US)

(73) Assignee: Lucid Presence, LLC, Sheridan, WY (US)

( * ) Notice: Subject to any disclaimer, the term of this patent is extended or adjusted under 35 U.S.C. 154(b) by 23 days.

(21) Appl. No.: 17/575,871

(22) Filed: Jan. 14, 2022

(65) Prior Publication Data

US 2022/0227561 A1 Jul. 21, 2022

Related U.S. Application Data

(60) Provisional application No. 63/137,912, filed on Jan. 15, 2021.

(51) Int. Cl.
*B65D 81/20* (2006.01)
*A45C 13/00* (2006.01)

(52) U.S. Cl.
CPC ..... *B65D 81/2038* (2013.01); *A45C 13/00* (2013.01); *B65D 81/2023* (2013.01)

(58) Field of Classification Search
CPC ..... B65D 81/2007; B65D 81/2023; B65D 81/2038; A45C 7/0081; A45C 13/00
USPC ..... 206/204, 524.3, 524.8, 524.9; 383/3, 383/61.2, 61.3, 109, 116
See application file for complete search history.

(56) References Cited

U.S. PATENT DOCUMENTS 4,164,968 A * 8/1979 Esposito, Jr. ..... A63B 71/0045 224/607
4,702,376 A * 10/1987 Pagliaro ..... A47L 9/14 206/524.8
6,059,457 A * 5/2000 Sprehe ..... B65D 33/2541 206/524.8
6,298,993 B1 * 10/2001 Kalozdi ..... A45C 3/00 206/581
2004/0074803 A1 * 4/2004 Otsubo ..... B65D 31/02 383/105
2004/0188310 A1 * 9/2004 Hamilton ..... B65D 33/01 206/524.8
2014/0353203 A1 * 12/2014 Hu ..... B65D 75/30 206/524.8

* cited by examiner

*Primary Examiner* — Luan K Bui
(74) *Attorney, Agent, or Firm* — Travis Banta; Loyal IP Law, PLLC

(57) ABSTRACT

A vacuum bag is disclosed. The vacuum bag may include a body. The body may include a plastic layer and a fabric layer. The plastic layer and the fabric layer may be welded together on at least one portion of the body. The vacuum bag may further include a seal bar and a valve.

19 Claims, 3 Drawing Sheets

SEALABLE VACUUM LUGGAGE BAG

PRIORITY

This application claims the benefit of U.S. Provisional Application No. 63/137,912, filed Jan. 15, 2021, which is incorporated herein by reference in its entirety, including but not limited to those portions that specifically appear hereinafter, the incorporation by reference being made with the following exception: In the event that any portion of the above-referenced provisional application is inconsistent with this application, this application supersedes said above-referenced provisional application.

BACKGROUND

1. Technical Field

This disclosure relates generally to a sealable vacuum luggage bag. More specifically, the sealable vacuum luggage bag may include one or more valves which allow air to exit the sealable vacuum luggage bag when sealed. Further, the sealable vacuum luggage bag may include anti-moisture and anti-microbial treatments which prevent moisture and odors from contaminating other clothing in luggage. The bag may be used in contexts outside of luggage such as for carrying items in a trunk or storing items in a small closet.

2. Description of the Related Art

Since humans began to travel from one place to another, devices have been used to transport a person's necessary or important belongings with them as the person traveled from place to place. Transportation vessels, such as baskets woven from reeds, bags made from simple fabrics, chests and trunks for the more affluent travelers, and simple pockets for more spartan travelers have all been used to transport a traveler's belongings. Bags, for example, have been used since antiquity to store important goods and protect them for traveling or for storage. For example, Joseph in Egypt transported and stored corn in sacks to prepare for a famine. Seemingly, those sacks would have been transported and stored with dried corn to prevent mold from ruining the corn.

In the latter half of the 20th century, as the advent of mass commercial airline travel produced innovation in luggage technology, which transitioned from chests and trunks that were suitable for traveling in ships across the ocean, to more airplane friendly luggage. In another example, duffel bags, which were popular among sailors lost popularity as airlines have promulgated luggage restrictions which restrict both a size and weight for baggage accepted for transport. Other improvements brought about by commercial airline travel include luggage that ensured or added to the protection of articles inside the luggage. Since commercial airline travel became available to the masses, luggage has been developed with soft or hard sides, roller wheels, and internal pockets which are useful to separate clean clothing, for example, from soiled clothing. More recently, consumers have spurred numerous innovations in luggage technology to enhance the traveling experience.

In particular, compressive bags, made from a layer of plastic, have been developed with a seal and a valve for two main purposes. First, the various bags are an efficient way to to sort articles of clothing in luggage (e.g., clean or soiled; day by day; wet from dry, etc.). Second, the various bags allow excess air to be removed from the bag and articles inside such that the bags occupy less room in the luggage than they would if not compressed and held in a compressed state in a vacuum.

These bags, however, also cause users some issues and a potential to ruin clothes with mildew or mold. For example, a wet swimming suit stored in a conventional bag used on the first day of the trip and stored in the bag after may experience mildew or mold due to the inability of moisture to leave the bag. The mildew or mold may stain or otherwise discolor or weaken the fabric that makes up the swimming suit. Thus, when the user returns home or to a laundromat, the user becomes aware that the swimming suit is ruined by an unpleasant aroma from mold escaping the bag with the swimming suit.

These bags are also susceptible to puncture. Since the bags are typically a thin plastic material, any sharp edge or point tends to perforate the bag and release the seal within the bag as air is able to move through the perforation in the bag. Reinforcement to the surface of these bags is unknown in the art. Further, being able to affix such bags within the luggage to minimize movement during handling of articles inside is unknown in the art.

It is therefore one object of this disclosure to provide a sealable vacuum luggage bag that is formed using fabric for reinforcement. Another object of this disclosure is to provide a bag with anti-moisture elements. Another object of this disclosure is to provide a bag with anti-microbial elements. Finally, an object of this disclosure is to provide a bag with connector elements.

SUMMARY

A vacuum bag is disclosed. The vacuum bag may include a body. The body may include a plastic layer and a fabric layer. The plastic layer and the fabric layer may be welded together on at least one portion of the body. The vacuum bag may further include a seal bar and a valve.

BRIEF DESCRIPTION OF THE DRAWINGS

The accompanying drawings illustrate an embodiment of a sealable vacuum luggage bag.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the sealable vacuum luggage bag disclosed herein. While the techniques and embodiments will primarily be described in context with the accompanying drawings, those skilled in the art will further appreciate that the techniques and embodiments may also be practiced in other similar apparatuses.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Primarily, it is noted that sealable vacuum luggage bag 100 ("bag 100") is explained with respect to use with luggage, but is not so limited. References to luggage and clothing are used solely for explanatory and exemplary purposes. Bag 100 may be used in any appropriate context where space, mold or mildew, or moisture for enclosed items may be a relevant consideration.

Figure 1:
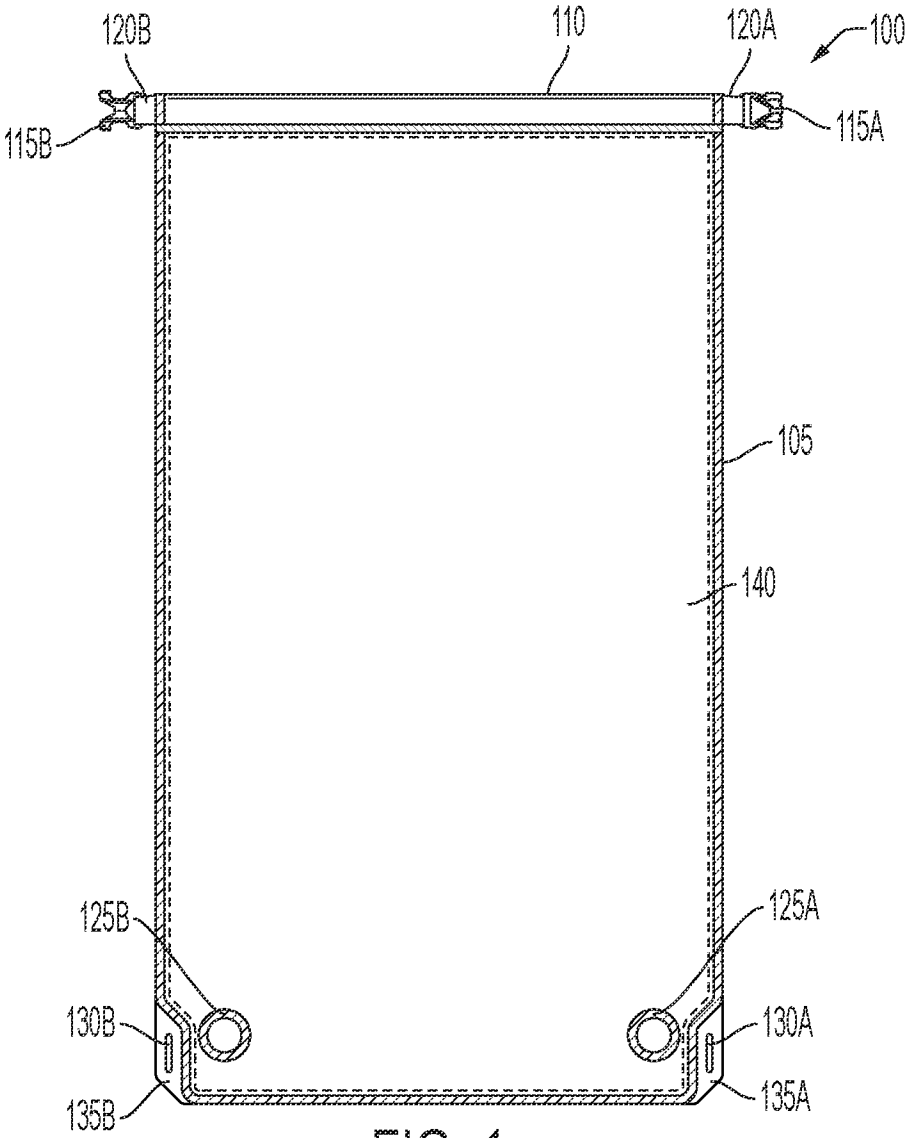
FIG. 1 illustrates an exemplary implementation of a front side of a sealable vacuum luggage bag.

FIG. 1 illustrates an exemplary implementation of a front side of a bag 100. Bag 100 includes a body 105 which may be made from fabric which encases a thermoplastic polyurethane film, or any other suitable plastic or plastic derivative known to those of ordinary skill in the art which may be formed into a bag having a bottom, two sides, and a top. One example of a fabric used to encase the thermoplastic polyurethane film may include a micro brushed polyester. Fabric used for the body of bag 100 may prevent unintentional perforations of the thermoplastic polyurethane film layer of body 105, making bag 100 far more durable than conventional vacuum bags. In addition, the fabric makes bag 100 more attractive and comfortable to hold both for filling bag 100 and for expelling air from bag 100, as will be discussed below. Seal bar 110 may include an air-tight seal using any of the techniques for providing an air-tight seal known in the art. For example, a tongue and groove joint may be molded into the plastic which causes the tongue and groove joint to form an air-tight seal until opposing forces are applied to opposing sides of bag 100 to separate the tongue and groove joint. The tongue and groove joint may be joinable in the same fashion as a zipper bag or zip top bag, for example. Other air-tight seals may be made using zippers, magnets, or other air-tight closures known in the art. The term "air-tight" may be construed as permanently or temporarily preventing air from passing from outside or inside bag 100 to the inside or outside of bag 100. Temporarily air-tight may mean that bag 100 may be sealed for a short period of time, such as several minutes.

Seal bar 110 may extend across a width of body 105 and define an opening of bag 100. Body 105 may be enclosed using techniques known in the art, including thermoplastic welding techniques. Seal bar 110 may further include fabric from body 105 which is extended at seal bar past a width of body 105 to provide loops 120A and 120B which are respectively connected to a corresponding connector element, such as buckle elements 115A and 115B which form a buckle 115. Loops 120A and 120B may be fashioned from fabric or the thermoplastic layer of body 105. Buckle 115 may be used to connect bag 100 to other bags, corresponding buckle elements in luggage, or secure an opening of bag 100 in a circular position.

Bag 100 may further include one or more valves, such as valves 125A and 125B illustrated in FIG. 1 which may be attached to body 105 of bag 100 by any technique known in the art including a thermoplastic welding technique. Valves 125A and 125B may be implemented with a diaphragm and or a one-way valve to allow air to pass from inside the bag to outside the bag but prevent air from outside the bag from entering into the bag through the valve. Other types of valves installed in the bag are possible, such as a welded one-way valve, a one way maze welded valve, or a one way valve with a plurality of openings between horizontal and vertically joined series of welds. Two valves are illustrated as valve 125A and valve 125B, but this is merely for illustrative purposes. Any number of valves may be implemented in body 105 of bag 100. Valves 125A or 125B may also be placed anywhere on bag 100. However, FIG. 1 illustrates an embodiment where valves 125A and 125B are disposed at an end of bag 100 that is opposite the end created by seal bar 110 to allow for air to be squeezed from a sealed seal bar 110 towards valves 125A and 125B. In this manner, bag 100 may be rolled or compressed to push air through valves 125A and 125B, as shown in FIG. 1. Valves 125A and 125B allow air to pass through valves 125A and 125B as a one-way valve. Once the air is evacuated from inside bag 100 through valves 125A and 125B, valves 125A and 125B prevent air from reentering bag 100 through valves 125A and 125B. Since seal bar 110 is sealed in an air-tight fashion, preventing ambient air from entering bag 100, and air is evacuated through valves 125A and 125B, a vacuum condition may be created within bag 100. Articles such as clothing, clean or soiled, may therefore be enclosed in bag 100 and protect other clothing from becoming soiled or being contaminated by soiled clothing.

Bag 100 may further include apertures 130A and 130B in corner reinforcements 135A and 135B. Apertures 130A and 130B may be used to tether a bag 100 in a particular position inside a luggage case or may be used to attach multiples of bag 100 together within a luggage case. For example, buckle 115 and apertures 130A and 130B may be used in conjunction to organize clothing into bags each having a complete set of clothing for a day of traveling. To clarify, the use of clothing in bag 100 is purely explanatory and exemplary. Any item may be contained within bag 100 including pillows, blankets, coats, medications, or any other item that may benefit from being enclosed within a bag 100 sealed from external ambient air for the convenience or appropriateness of a bag 100 user. A further benefit is that when a vacuum condition is created within bag 100 by evacuating air through valves 125A and 125B, as shown in FIG. 1, the items contained within the bag, especially soft items, require less space in a luggage case, a trunk, or a small closet.

As shown in FIG. 1, a coating or layer 140 of anti-microbial material may be positioned throughout or in a specific area(s) of an inside portion of bag 100. Anti-microbial material may include materials that inhibit the growth of bacteria, fungi (anti-fungal), viruses (anti-viral), and parasites (anti-parasitic). Anti-microbial coating 140 may be implemented with a chemical substance which prevents or substantially reduces the growth of undesirable bacteria/fungi/viruses/mold/mildew but also does not harm the clothing within. Exemplary anti-microbial material may include chemicals such as halogenated aromatic compounds, nanosilver, quaternary ammonium compounds, antiseptics, or any other suitable material known in the art. Antimicrobial layer 140 may prevent or substantially reduce the growth of microbial material, such as bacteria, fungi, viruses, mold, mildew, etc., within bag 100.

Figure 2:
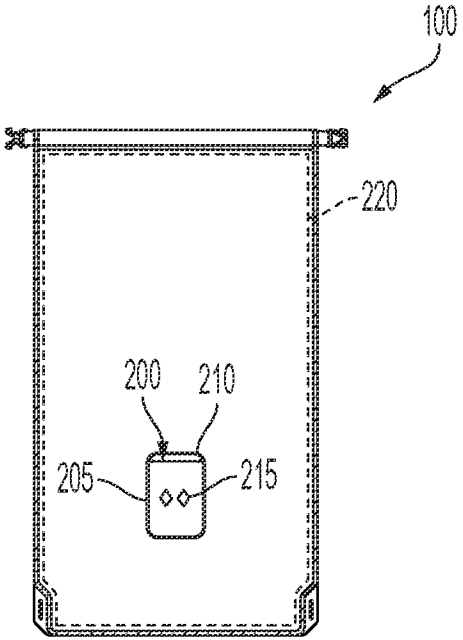
FIG. 2 illustrates an exemplary implementation of an inside of a sealable vacuum luggage bag.

FIG. 2 illustrates an exemplary implementation of an inside of bag 100. As shown in FIG. 2, bag 100 may include a pocket 205 disposed on an inside surface of bag 100, which may be welded to bag 100 by a thermoplastic weld 200 which illustrates one exemplary implementation for connecting pocket 205 to bag 100. Pocket 205 is representative of a plurality of pockets that may be installed within bag 100 to hold multiple desiccants or odor absorbing packets. This disclosure is not limited to the use of a single pocket within bag 100 and may implement a plurality of pockets for various different uses. Pocket 205 may include an opening 210, such as a slit. Pocket 205 may receive a desiccant to remove moisture from bag 100 and/or an odor absorber. Both the desiccant and odor absorber may be implemented as desiccant or odor absorbing packages which may be disposed in pocket 205. Pocket 205 may include one or more perforations 215, or even a plurality of perforations 215, which allow a desiccant or odor absorbing package within pocket 205 to interact with the surrounding environment within bag 100 and reduce a moisture level or odor level within bag 100. As shown in FIG. 2, an antimicrobial layer 220, which is similar to antimicrobial layer 140 discussed above with respect to FIG. 1, may be applied to an inside surface of a pocket 205 in a manner similar to that of layer 140 being applied to an inside surface of bag 100.

Figure 3:
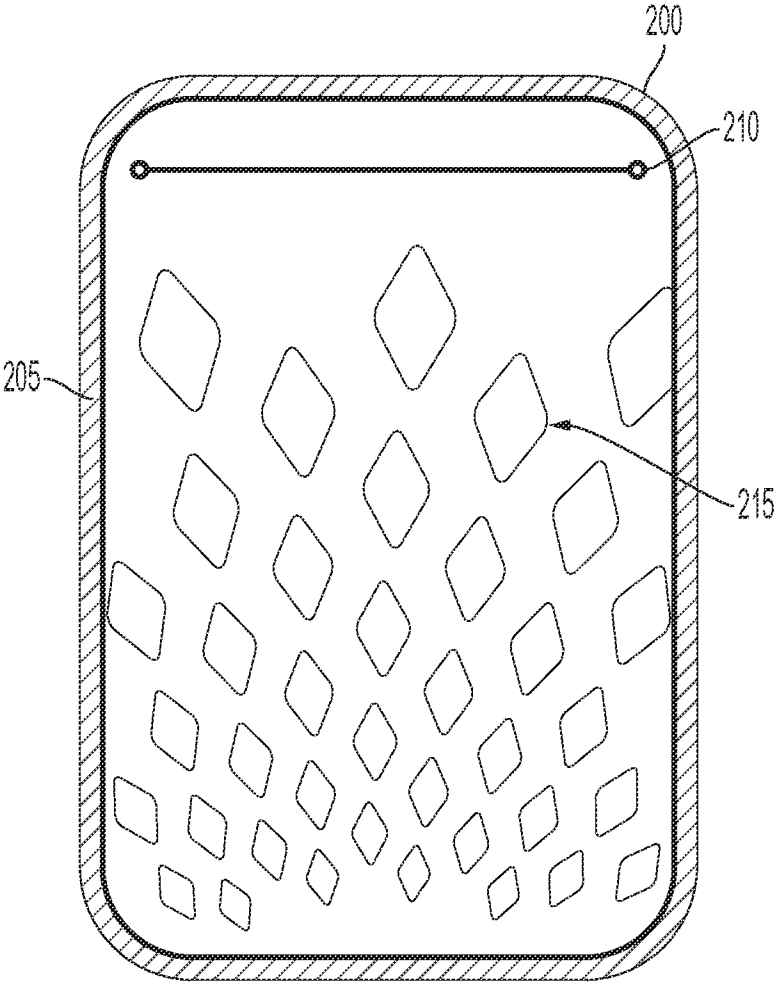
FIG. 3 illustrates an exemplary implementation of an internal pocket of the sealable vacuum luggage bag.

FIG. 3 illustrates an exemplary implementation of an internal pocket 205 of bag 100. As shown in FIG. 3, bag 100 may include a pocket 205 disposed on an inside surface of bag 100, which may be welded to bag 100 by a thermoplastic weld 200 which illustrates one exemplary implementation for connecting pocket 205 to bag 100. Pocket 205 may include an opening 210, such as a slit. Pocket 205 may receive a desiccant to remove moisture from bag 100 and/or an odor absorber. Both the desiccant and odor absorber may be implemented as desiccant or odor absorbing packages which may be disposed in pocket 205. Pocket 205 may include one or more perforations 215, or even a plurality of perforations 215, which allow a desiccant or odor absorbing package within pocket 205 to interact with the surrounding environment within bag 100 and reduce a moisture level or odor level within bag 100.

Figure 4A:
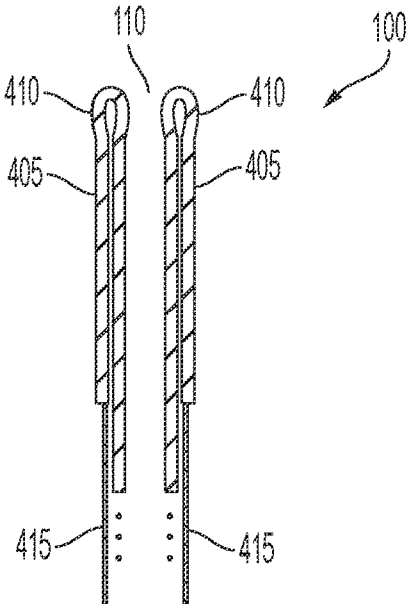
FIG. 4A illustrates an exemplary embodiment of a horizontal cross-sectional view of a top end of a sealable vacuum luggage bag.

FIG. 4A illustrates an exemplary embodiment of a horizontal cross-sectional view of a top end of a bag 100. As illustrated in FIG. 4A, seal bar 110 is shown for reference at a top end of bag 100. A top portion of bag 100 may be provided by rolling a plastic layer 405 over to form rolled tops 410 which may receive a seal joint, such as a tongue and groove joint, discussed above, zip top technology or any other seal technology. The seal joint may also be implemented below rolled tops 410 which establish a top-most portion of bag 100. As shown in FIG. 4A, plastic layer 405 may be welded below rolled tops 410 to seal an opening around bag 100.

Plastic layer 405 may further be welded to fabric 415, which may be implemented as a shell around bag 100, as described above, using techniques known in the art. While plastic layer 405 may extend downwards from seal bar 110, as shown in FIG. 1, for example, a portion of fabric layer 415 may be added to a point at which plastic layer 405 ends on an outside of bag 100 to provide adequate space for fabric 415 to be welded to plastic layer 405.

Figure 4B:
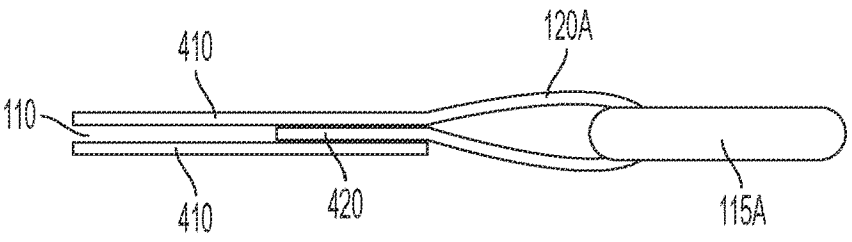
FIG. 4B illustrates an exemplary embodiment of a top view of a top end of the sealable vacuum luggage bag shown in FIG. 4A.

FIG. 4B illustrates an exemplary embodiment of a top view of a top end of bag 100, shown in FIG. 4A. As shown in FIG. 4B, bag 100 may include seal bar 110 and may be terminated at a top end by rolled top 410. Rolled top 410 may be formed by plastic layer 405, shown in FIG. 4A which extends from a width of bag 100 to create a loop 120A to secure buckle 115A to bag 100. One side of rolled top 410 may be extended to create a weld point 420 where the two sides of rolled top 420 may be joined together by welding.

Figure 5A:
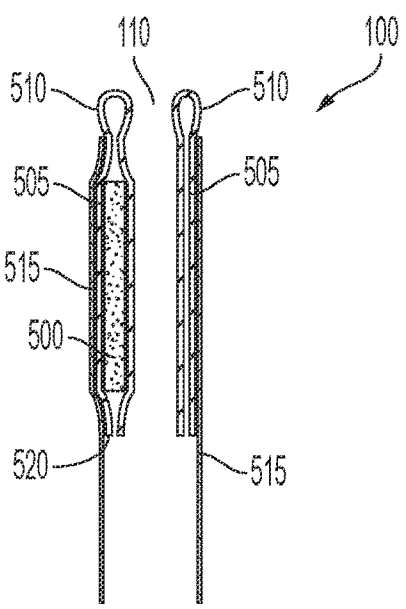
FIG. 5A illustrates an exemplary alternative embodiment of a horizontal cross-sectional view of a top end of a sealable vacuum luggage bag.

FIG. 5A illustrates an exemplary alternative embodiment of a horizontal cross-sectional view of a top end of bag 100. As illustrated in FIG. 5A, seal bar 110 is shown for reference at a top end of bag 100. A top portion of bag 100 may be provided by rolling a plastic layer 505 over to form rolled tops 510 which may receive a seal joint, such as a tongue and groove joint, discussed above, zip technology or any other seal technology. The seal joint may also be implemented below rolled tops 510 which establish a top-most portion of bag 100. As shown in FIG. 5A, plastic layer 505 may be welded below rolled tops 510 to seal an opening around bag 100. At the same time, fabric layer 515 may also be welded to plastic layer 510 at a point just below rolled tops 510 on an outside of bag 100, such that fabric layer 515 encompasses bag 100. A second weld point 520 may be positioned below a stiffener 500, which may be disposed between opposing sides of one of rolled tops 510 on plastic layer 505. Stiffener 500 may be implemented as a plastic, metal, or wooden material which provides increased stiffness on one side of bag 100. Stiffener 500 may be captured between a weld point 520 positioned below rolled tops 510 and below stiffener 500. Fabric layer 515 may further be welded to plastic layer 505 at second weld point 520.

Figure 5B:
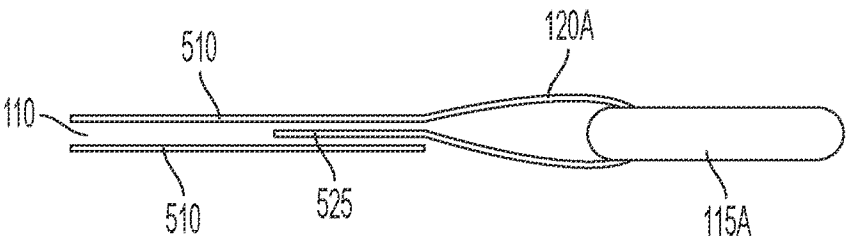
FIG. 5B illustrates an exemplary embodiment of a top view of a top end of the sealable vacuum luggage bag shown in FIG. 5A.

FIG. 5B illustrates an exemplary embodiment of a top view of a top end of the sealable vacuum luggage bag shown in FIG. 5A. As shown in FIG. 5B, bag 100 may include seal bar 110 and may be terminated at a top end by rolled top 510. Rolled top 510 may be formed by plastic layer 505, shown in FIG. 5A which extends from a width of bag 100 to create a loop 120A to secure buckle 115A to bag 100. One side of rolled top 510 may be extended to create a weld point 525 where the two sides of rolled top 525 may be joined together by welding.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A vacuum bag, comprising:

a body comprising a plastic layer and a fabric layer, wherein the plastic layer and the fabric layer are welded together on at least one portion of the body;

a seal bar;

a valve; and an antimicrobial layer disposed on an inside surface of the vacuum bag.

2. The vacuum bag of claim 1, further comprising a pocket disposed within the vacuum bag.

3. The vacuum bag of claim 2, wherein the pocket includes an opening.

4. The vacuum bag of claim 2, wherein the pocket includes one or more perforations.

5. The vacuum bag of claim 4, wherein the pocket is welded to an inside surface of the vacuum bag.

6. The vacuum bag of claim 1, wherein the seal bar includes a seal joint.

7. The vacuum bag of claim 6, wherein the seal joint prevents air from entering or exiting the vacuum bag through the seal joint when the seal joint is sealed.

8. The vacuum bag of claim 1, further comprising a second valve.

9. The vacuum bag of claim 1, wherein the valve is a one-way air valve.

10. The vacuum bag of claim 1, further comprising a loop disposed at a top end of the vacuum bag.

11. The vacuum bag of claim 10, further comprising a buckle element attached to the loop.

12. The vacuum bag of claim 10, further comprising a second loop disposed at an opposing end of the top end of the vacuum bag.

13. The vacuum bag of claim 12, further comprising a buckle element attached to the loop.

14. The vacuum bag of claim 1, further comprising corner reinforcements.

15. The vacuum bag of claim 14, wherein the corner reinforcements include an aperture.

16. The vacuum bag of claim 1, further comprising a stiffener disposed between a layer of plastic inside the vacuum bag and a layer of plastic outside the vacuum bag.

17. The vacuum bag of claim 16, wherein the layer of plastic inside the vacuum bag and the layer of plastic outside the vacuum bag is separated by a top.

18. The vacuum bag of claim 17, wherein the layer of plastic inside the vacuum bag and the layer of plastic outside the vacuum bag is welded together below the top and below the stiffener, such that the stiffener is captured between the weld below the top and the weld below the stiffener.

19. The vacuum bag of claim 18, wherein the fabric layer is further welded to the layer of plastic outside the vacuum bag.

* * * * *